United States Patent [19]

Richards

[11] 4,041,848

[45] Aug. 16, 1977

[54] METHOD OF MAKING CONTAINER

[75] Inventor: Frank P. Richards, Kansas City, Mo.

[73] Assignee: Phillips Petroleum Company, Bartlesville, Okla.

[21] Appl. No.: 640,592

[22] Filed: Dec. 15, 1975

Related U.S. Application Data

[62] Division of Ser. No. 511,271, Oct. 2, 1974, Pat. No. 3,944,126.

[51] Int. Cl.[2] ..... B31B 49/02

[52] U.S. Cl. ..... 93/36.5 R; 93/39.1 R; 113/120 K

[58] Field of Search ..... 93/36.5 R, 36.5 SS, 93/39 C, 39.1 R, 55.1 R, 55.1 M; 156/203; 113/120 K, 120 Y, 121 R, 121 A, 121 C, 1 E; 220/67, 75, 76

[56] References Cited

U.S. PATENT DOCUMENTS

| | | | |
|---|---|---|---|
| 570,591 | 11/1896 | Ams | 113/120 Y |
| 2,188,291 | 1/1940 | Zeigmeister | 113/120 K |
| 2,299,090 | 10/1942 | Hothersall | 113/120 Y |
| 2,667,823 | 2/1954 | Potter et al. | 93/36.5 R X |
| 3,202,065 | 8/1965 | Bolcato | 93/39.1 R X |
| 3,365,111 | 1/1968 | McNair, Jr. et al. | 229/17 |

*Primary Examiner*—James F. Coan

[57] ABSTRACT

A container is formed from a generally rectangular blank of paperboard or the like which is rolled to form a cylindrical or conically shaped side wall. A circular disc is secured to one end of the side wall to form an end closure. Leakage at the junction between the side wall seam and the disc is eliminated by positioning a bead of sealant material at this junction. Blanks employed to construct the container are also disclosed.

6 Claims, 5 Drawing Figures

METHOD OF MAKING CONTAINER

This application is a division of copending application Ser. No. 511,271 filed Oct. 2, 1974, now U.S. Pat. No. 3,944,126.

Increasing use is being made in the packaging industry of containers formed of relatively low-priced paperboard, cardboard, and the like. Cylindrical containers formed of these materials are often constructed by spirally wrapping a strip of material on a mandrel. However, this method of construction requires the use of rather complex machinery and results in a container with a relatively long sprial seam. Another procedure for forming cylindrical containers involves formimg the side wall from a rectangular blank which is rolled on a mandrel to form the cylindrical side wall. A circular disc is secured to one end to form the end closure. While this procedure is satisfactory for many applications, leaks may develop at the junction between the side wall seam and the end disc.

In accordance with one embodiment of this invention, an improved cylindrical container is constructed from a rectangular side wall blank and a circular end disc having a depending skirt. Leakage at the junction between the side wall seam and the bottom seam is eliminated by positioning a bead of sealant material at this junction. In one embodiment, the sealant is placed on the side wall blank before the cylindrical container is formed. In another embodiment, the sealant is placed on the end closure disc before the container is formed. Blanks of paperboard and the like to be used in forming the container of this invention are also provided.

In the accompanying drawing.

Figure 1:
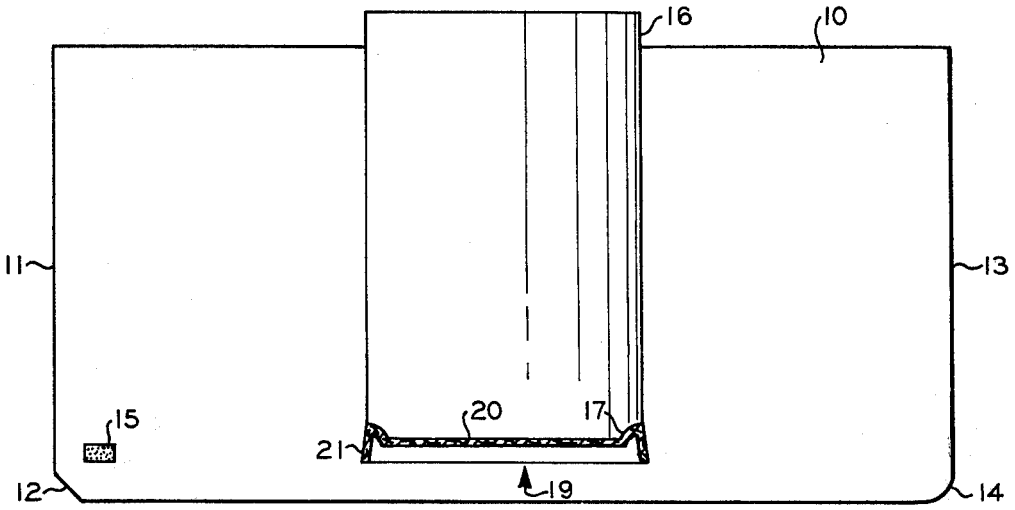
FIG. 1 illustrates blanks employed to form the container of this invention and a mandrel employed in the container assembly.

Referring now to the drawing in detail and to FIG. 1 in particular, there is shown a generally rectangular blank 10 which is formed of paperboard, cardboard or the like. The surfaces of this blank are advantageously coated with a thermoplastic material such as polyethylene or a wax which reduces the permeability of the blank and which assists in sealing the edges of the blank when the container is formed. The left-hand edge 11 of blank 10 is provided with a cutoff corner 12, and the right-hand edge 13 is provided with a rounded corner 14. Sealant material 15, to be described in greater detail hereinafter, is positioned on the inner face of blank 10 near corner 12.

Figure 3:
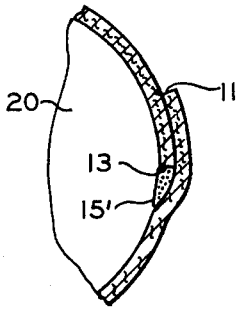
FIG. 3 is a view taken along line 3—3 in FIG. 2.
Figure 2:
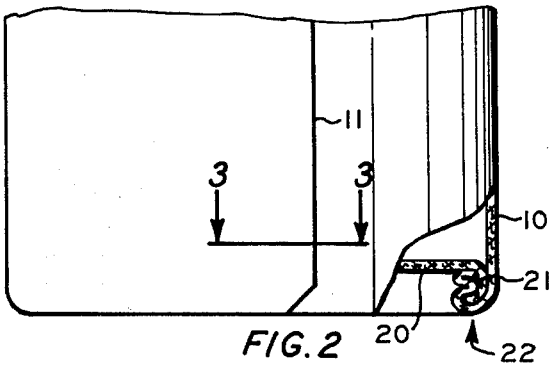
FIG. 2 is a view, shown partially in section, of one end of a container of this invention.

The side wall of the container is formed by heating edges 11 and 13 of blank 10 and wrapping blank 10 a cylindrical mandrel 16, which is provided with a recess 17 at the lower edge. A bottom closure 19 for the container comprises a generally cylindrical disc 20 of coated paperboard, cardboard or the like, which has a depending skirt 21 thereon. This end closure is positioned in engagement with mandrel 16, as illustrated. Edge 13 is rolled onto the mandrel, followed by edge 11, so that edge 11 overlaps edge 13, as illustrated in FIG. 3. Pressure is applied to seal these edges. The bottom edge of blank 10 and the end closure are heated and a crimping roller, not shown, then engages the lower edge of blank 10 and forces it into engagement with skirt 21 to form a crimped seal 22, such as illustrated in FIG. 2. The heat supplied to edges 11 and 13 of blank 10 and to the region of crimp 22 serves to melt the coating on the blank and on end closure 19 to form fluid-tight seals.

In accordance with this invention, sealant 15 is positioned so as to fill the space between edges 13 and side 11 at the region this seam joins crimp 22. The application of heat in the sealing process serves to melt sealant 15 so as to form a seal at the junction of the seam and depending skirt of the end closure. The final solidified sealant 15' is illustrated in FIG. 3.

Figure 4:
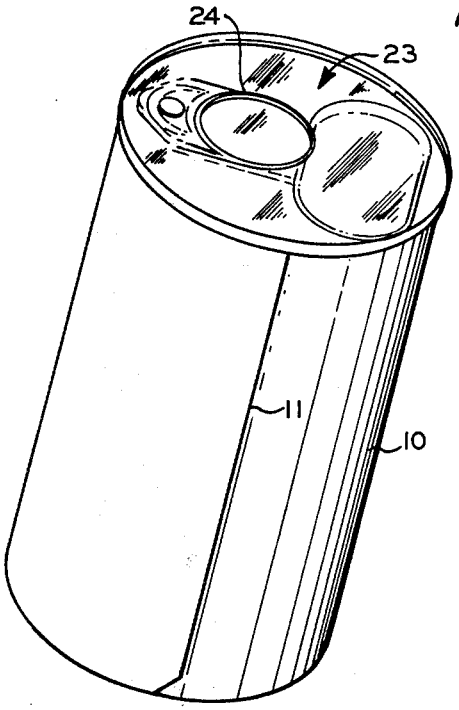
FIG. 4 illustrates a container of this invention having a second end closure thereon.

The second end of the container can be closed after filling by any suitable end closure. In the embodiment illustrated in FIG. 4, an end closure 23 provided with a pull ring 24 is crimped to the top of the container. However, other types of end closures such as solid discs and those containing pour spouts or tear tabs can also be employed.

Figure 5:
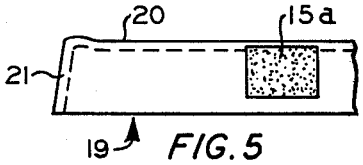
FIG. 5 illustrates a blank employed to form an end closure of the container.

A second embodiment of the sealing construction of this invention is illustrated in FIG. 5 wherein sealant **15*a* is deposited on end closure 19. This sealant is positioned on the end closure in the region of the seam which is formed by the overlapped edges of blank 10.** Such a sealant can be positioned on the end closure before the end closure is positioned on the mandrel, but this requires that the end closure be aligned carefully on the mandrel. Another alternative involves depositing the sealant on the end closure after it is positioned on the mandrel and before the side wall blank is wrapped onto the mandrel.

The sealant 15 or **15*a* preferably is a heat-sensitive material which melts when the container is formed and thereby fills the joint at the seam. Various thermoplastic resins and waxes and hot melt adhesives can be employed. Examples of suitable materials include paraffin wax, gelled lacquer, microcrystalline wax, polyethylene and the like. The sealant should be carfeully placed on the side wall blank or the bottom closure so as to fill the joint when the container is assembled. A minimum amount of sealant to provide the necessary seal should be employed. In some instances, the sealant can be applied immediately before the container is assembled. This minimizes any stacking problems that may be encountered if excessive sealant should be placed on the blanks. In general, the spot of sealant 15 or 15*a*** extends less than about 1/15 of the circumference of the container.

This invention has been described in conjunction with the manufacture of cylindrical containers from rectangular side wall blanks. However, it should be apparent that containers having the shape of a frustum can also be made from blanks which, while being generally rectangular, are fan-shaped with curved upper and lower edges as illustrated in U.S. Pat. No. 3,157,339, for example.

While this invention has been described in conjunction with presently preferred embodiments, it should be evident that it is not limited thereto.

What is claimed is:

1. The method of constructing a container from a geneally rectangular blank of paperboard or the like and a bottom closure member in the form of a generally circular disc having a depending skirt, which method comprises: positioning a bead of sealant on the blank near one corner thereof; forming the blank having the bead of sealant thereon into a cylindrical or conical side wall by lapping the side edge of the blank adjacent the bead of sealant over the other side edge so that the bead of sealant is on the inner side of the side wall at the resulting inner seam, and positioning the bottom closure member in the end of the side wall adjacent the bead of sealant; and sealing the side edges of the blank and crimping the bottom edge of the blank to the depending skirt to form the container, said bead of sealant having been positioned on said blank at a location such that the sealant is at the junction of the inner side wall seam and the inner seam formed by the blank and bottom closure member.

2. The method of claim 1 wherein said bead of sealant positioned on said blank is of such size as to extend less than about 1/15 of the circumference of said disk.

3. The method of claim 2 wherein said generally rectangular blank has one bottom corner cut off and the other bottom corner rounded, the side wall being formed by lapping the side edge of the blank having the cut off corner over the side edge of the blank having the rounded corner.

4. The method of constructing a container from a generally rectangular blank of paperboard or the like and a bottom closure member in the form of a generally circular disk having a depending skirt, which method comprises: positioning a bead of sealant on the outside of the skirt of the bottom closure member; forming the blank into a cylindrical or conical side wall by lapping one side edge of the blank over the other side edge of the blank, and positioning the bottom closure member having the bead of sealant thereon in the end of the side wall so that the bead of sealant is located at the inner seam of the lapped side wall; and sealing the side edges of the blank and crimping the bottom edge of the depending skirt to form the container.

5. The method of claim 4 wherein said bead of sealant positioned on said skirt is of such size as to extend less than about 1/15 of the circumference of said disk.

6. The method of claim 5 wherein said generally rectangular blank has one bottom corner cut off and the other bottom corner rounded, the side wall being formed by lapping the side edge of the blank having cut off corner over the side edge of the blank having the rounded corner.

* * * * *

UNITED STATES PATENT AND TRADEMARK OFFICE

CERTIFICATE OF CORRECTION

PATENT NO. : 4,041,848

DATED : August 16, 1977

INVENTOR(S) : Frank P. Richards

It is certified that error appears in the above-identified patent and that said Letters Patent are hereby corrected as shown below:

Column 2, line 64, "geneally" should be --- generally ---;

line 66, "disc" should be --- disk ---.

Column 4, line 21, "having cut" should be --- having the cut ---.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*